US012005494B2

(12) United States Patent
Hackl et al.

(10) Patent No.: US 12,005,494 B2
(45) Date of Patent: Jun. 11, 2024

(54) STOPPER ROD AND A METHOD FOR PROVIDING A UNIFORM GAS CURTAIN AROUND A STOPPER ROD

(71) Applicant: Refractory Intellectual Property GmbH & Co. KG, Vienna (AT)

(72) Inventors: Gernot Hackl, Trofaiach (AT); Wolfgang Fellner, Leoben (AT)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 330 days.

(21) Appl. No.: 17/437,016

(22) PCT Filed: Jan. 28, 2020

(86) PCT No.: PCT/EP2020/052020

§ 371 (c)(1),
(2) Date: Sep. 7, 2021

(87) PCT Pub. No.: WO2020/182362

PCT Pub. Date: Sep. 17, 2020

(65) Prior Publication Data

US 2022/0176446 A1 Jun. 9, 2022

(30) Foreign Application Priority Data

Mar. 8, 2019 (EP) ..... 19161721

(51) Int. Cl.
*B22D 41/18* (2006.01)

(52) U.S. Cl.
CPC ..... *B22D 41/186* (2013.01)

(58) Field of Classification Search
CPC ..... B22D 41/16; B22D 41/18; B22D 41/58; B22D 41/186
See application file for complete search history.

(56) References Cited

U.S. PATENT DOCUMENTS

| | | | |
|---|---|---|---|
| 6,464,116 | B1 | 10/2002 | Hanse |
| 2008/0106011 | A1 | 5/2008 | Lee et al. |

FOREIGN PATENT DOCUMENTS

| | | | | |
|---|---|---|---|---|
| AT | 340620 | B | 12/1977 | |
| CN | 101080293 | A | 11/2007 | |
| CN | 106392051 | A | 2/2017 | |
| EP | 0411999 | A1 | 2/1991 | |
| EP | 1736260 | A1 | 12/2006 | |
| EP | 2572813 | A1 * | 3/2013 | ..... B22D 41/186 |
| JP | H03110048 | A | 5/1991 | |
| JP | H10296406 | A | 11/1998 | |
| KR | 20140082497 | A | 7/2014 | |

(Continued)

OTHER PUBLICATIONS

"Office Action for Chinese Patent Application No. 202080018621.6", dated Jun. 30, 2022, 6 pages.

(Continued)

*Primary Examiner* — Kevin P Kerns
*Assistant Examiner* — Steven S Ha
(74) *Attorney, Agent, or Firm* — Calfee, Halter & Griswold LLP

(57) ABSTRACT

The invention concerns a stopper rod and a method to provide a uniform gas curtain around a stopper rod.

14 Claims, 6 Drawing Sheets

(56) References Cited

FOREIGN PATENT DOCUMENTS

Figure 1A:
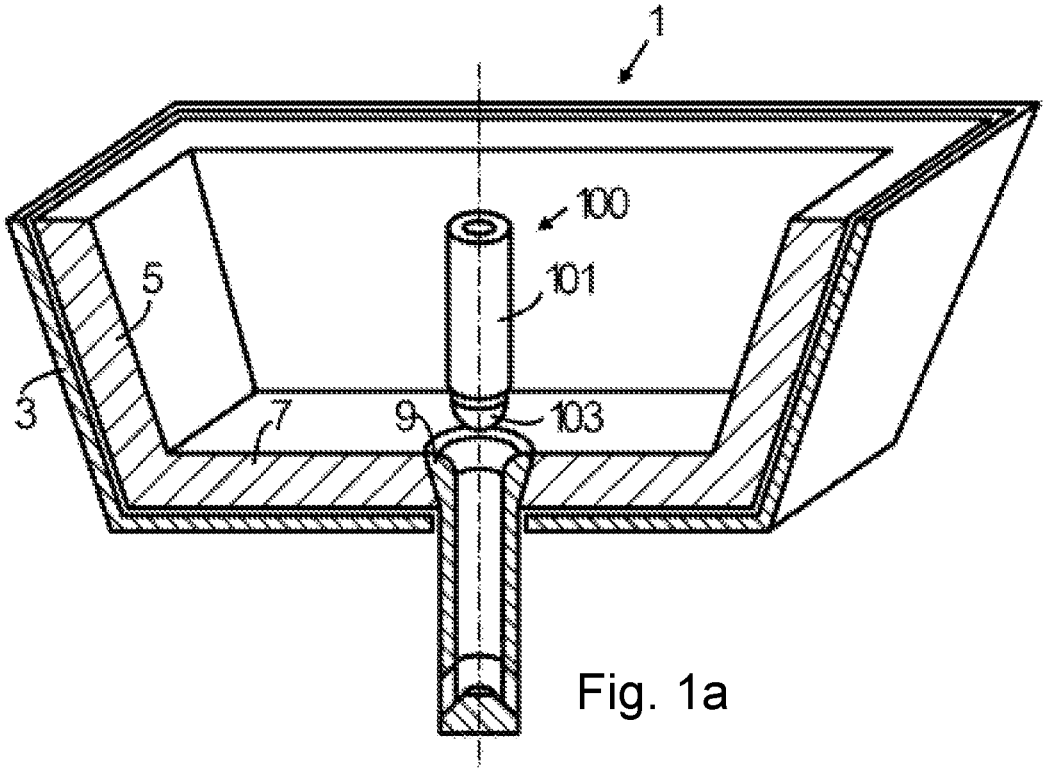

| | | | |
|---|---|---|---|
| KR | 101584135 | B1 | 1/2016 |
| WO | 2020182362 | A1 | 9/2020 |

OTHER PUBLICATIONS

"Examination Report for Indian Patent Application No. 202147038700", dated Apr. 28, 2023, 5 pages.
"International Search Report for PCT Patent Application No. PCT/EP2020/052020", dated Apr. 3, 2020, 3 Pages.
"Written Opinion of the International Searching Authority for PCT Patent Application No. PCT/EP2020/052020", dated Apr. 3, 2020, 6 Pages.

* cited by examiner

STOPPER ROD AND A METHOD FOR PROVIDING A UNIFORM GAS CURTAIN AROUND A STOPPER ROD

The invention concerns a stopper rod and a method for providing a uniform gas curtain around a stopper rod.

In the continuous casting of molten metal, in particular molten steel in a continuous casting plant, molten metal is provided in a vessel, in particular in a vessel in the form of a ladle or a tundish.

An outlet is provided in the bottom of the vessel in which the molten metal is provided, through which the molten metal in the vessel can be casted into a downstream aggregate located under the vessel.

In the bottom of a tundish such an outlet in the form of a tundish nozzle is provided. Such a tundish nozzle can be provided in the form of a submerged entry nozzle (SEN) or a submerged entry shroud (SES). Molten metal from the tundish can be casted through the tundish nozzle into the mould. Stopper rods are provided to control the amount of molten metal flowing through the outlet, in particular a tundish nozzle.

These stopper rods have a rod-shaped stopper body which is vertically aligned above the outlet, e.g. above the tundish nozzle. At its upper end, a metal rod is attached to the stopper rod, whereby the metal rod is in turn connected to a lifting device via which the stopper rod can be lifted and lowered vertically. At its lower end, the stopper rod has a nose, also known as the "stopper nose". By lowering the stopper rod, the nose can be guided against the outlet in such a way that the outlet can be completely closed by the nose and no more molten metal can flow through the outlet.

Furthermore, the stopper rod can be lifted vertically so that it releases the outlet and molten metal can flow through the outlet. Accordingly, the flow rate of molten metal through the outlet, e.g. the tundish nozzle, can be controlled by means of the stopper rod.

During casting, particles present in the molten metal may be deposited on the refractory material, in particular on the stopper rod, the outlet or the immersion nozzle downstream of a tundish nozzle. These particles can be especially alumina particles present in the molten metal. This deposit is also known as "clogging". In order to suppress clogging, it is known that an inert gas, especially argon or nitrogen, is introduced into the molten metal in the area of the nose of the stopper rod, whereby clogging can be suppressed.

For example, generic stopper rods with a gas outlet in the nose area are described in EP 2 067 549 A1, EP 2 189 231 A1 or EP 2 233 227 A1.

However, the introduction of gas into the molten metal in the area of the nose of the stopper rod may lead to a chaotic, uneven deflection of the stopper rod in alternating directions during casting (referred to as "deflection" hereinafter). This deflection during casting can have a negative effect on the quality of the cast metal.

The invention is based on the object of providing a stopper rod for controlling the flow of molten metal and for supplying supply gas during the casting of molten metal, wherein during the casting process and the simultaneous introduction of gas through the stopper rod into the molten metal the deflection of the stopper rod is reduced compared to the deflection of stopper rods according to the state of the art.

A further object of the invention is to provide a method for the use of such a stopper rod.

In order to solve the problem, the invention provides a stopper rod for controlling the flow of molten metal and for supplying gas during casting of molten metal, said stopper rod comprising:

- a rod-shaped stopper body, said rod-shaped stopper body extending along a central longitudinal axis from a first end to a second end, said rod-shaped stopper body defining a nose adjacent to said second end, wherein said nose provides an exterior surface;
- a chamber, said chamber extending along said central longitudinal axis into said stopper body from said first end towards said second end and ending at a distance from said second end;
- a channel, said channel being provided on said exterior surface of said nose, and running around said longitudinal axis;
- gas supply means, said gas supply means leading from said chamber and through said rod-shaped stopper body into said channel.

The invention is based on the basic finding that the deflection of a stopper rod during the casting process and the simultaneous supply of gas through the stopper rod into the molten metal is due to the fact that the gas is not uniformly released from the nose of the stopper rod into the molten metal. Rather, according to the invention it was found that in the case of stopper rods according to the state of the art, the gas introduced from the stopper nose into the molten metal rises non-uniformly around the stopper rod in the molten metal upwards, thus triggering the said deflection of the stopper rod.

Surprisingly, according to the invention it has been found that this deflection of the stopper rod can be significantly reduced by introducing the gas from the stopper rod uniformly into the molten metal. In particular, the invention has shown that the deflection of the stopper rod can be significantly reduced by introducing the gas from the stopper rod into the molten metal in such a way that a uniform gas curtain is formed around the stopper rod. According to the invention, therefore, means are provided on the stopper rod according to the invention through which gas from the stopper rod can be introduced uniformly into the molten metal. In particular, means are provided by which a uniform gas curtain can be formed around the stopper rod.

The features of the stopper rod according to the invention are therefore designed in such a way that gas can be introduced uniformly into the molten metal through the stopper rod according to the invention and, in particular, a uniform gas curtain can be provided around the stopper rod.

An essential element of these means for uniformly introducing gas from the stopper rod into the molten metal is the channel of the stopper rod provided on the exterior surface of the nose and running around the longitudinal axis of the stopper body. The gas supply means are used to introduce gas from said chamber of the stopper rod into said channel. The channel also acts as a gas distribution chamber in which the gas, introduced into the channel by the gas supply means, can collect and distribute. Since the channel is located on the exterior surface of the stopper nose and runs completely around the longitudinal axis, gas collected and distributed in the channel can be uniformly introduced into the molten metal along the entire circumferential surface of the stopper nose. In this respect, the channel is designed to receive gas from the gas supply and distribute it evenly across the channel.

The gas released from the channel therefore not only allows gas to be introduced uniformly into the molten metal, but also to form a uniform gas curtain around the stopper rod.

In an outward direction of the channel, i.e. on the side of the channel facing away from the stopper body, the channel is preferably completely open. This has the advantage that gas can be introduced into the molten metal over the entire length of the channel and thus gas can be introduced very uniformly into the molten metal.

The channel is bordered by walls (except on the side of the channel facing away from the stopper body). This has the advantage that gas, introduced into the channel from the gas supply means, can be collected in the channel.

Basically, the cross-sectional area of the channel, i.e. the cross-sectional area of the channel in a direction perpendicular to the longitudinal course of the channel, can have any shape, that is for example a generally round cross-sectional area (i.e. a C-shaped cross-sectional area), a cross-sectional area with a semi-circular channel bottom and straight side walls (i.e. a U-shaped cross-sectional area) or a cross-sectional area with a flat channel bottom and straight side walls (i.e. a square, e.g. rectangular or square cross-sectional area).

Particularly preferred, the channel has a V-shaped cross-sectional area. Accordingly, the channel has a shape, where the side-walls of channel diverge from a common area (which builds the channel bottom) towards the exterior surface of the nose (thus in one direction away from the longitudinal axis); finally, the side walls merge into the exterior surface of nose. According to the invention, it was found, that gas can be introduced from the channel into molten metal especially uniformly if the channel has such a V-shaped cross-sectional area.

According to a preferred embodiment, the channel has a uniform cross-sectional area. Accordingly, the cross-sectional area of the channel does not change over the course of the channel. This means that gas can be collected very uniformly in the channel, so that such a uniform cross-sectional area of the channel in turn has the advantage that the gas can be released very uniformly from the channel and introduced into the molten metal.

According to a particularly preferred embodiment, the channel is designed continuously, i.e. runs continuously around the longitudinal axis. In other words, the channel has no beginning and no end, but runs endlessly or "infinitely" around the longitudinal axis. Furthermore, the channel has no obstacles or interruptions that could obstruct a gas flow along the channel. Such a continuous channel has many advantages. One advantage of such a continuous channel is that the gas pressure along the channel can be balanced so that the gas pressure along the channel is equal and the gas can be released from the channel into the molten metal at the same pressure and therefore with the same amount over the entire length of the channel. Furthermore, such a continuous channel has the advantage that the channel can be supplied with gas via the gas supply means even if the channel cannot be supplied with gas via some of the gas supply means, for example because some of the gas supply means are blocked. All these advantages in turn mean that the channel can be filled uniformly and completely with gas, so that gas can be introduced uniformly from the channel into the molten metal.

Basically, the channel may have any course, e.g. zigzag-shaped or wave-like shape, around the longitudinal axis. According to a preferred embodiment, the channel forms a ring, that is ring-shaped or has the shape of a circular ring. According to the invention is was found that by such a ring-shaped channel gas can be introduced particularly uniformly from the channel into the molten metal.

According to a particularly preferred embodiment, the channel, especially if it is ring-shaped, is rotationally symmetrical in relation to the longitudinal axis.

According to the invention it surprisingly turned out that the shape of the edge, which is defined by the area where the wall of the channel, limiting the channel towards the first end of the stopper body, merges into the exterior surface of the stopper nose (i.e. the "upper" edge of the channel in the functional position of the stopper), has a high influence on how gas is released from the channel into the molten metal. In this respect, according to the invention, it has surprisingly been found that gas can be introduced from the channel into the molten metal in a particularly uniform manner, especially if this edge is as sharp as possible. Therefore, according to a preferred embodiment it is provided that the channel comprises a first channel wall, limiting the channel in a direction towards said first end, wherein said first channel wall and said exterior surface of said nose form a first edge, and wherein said first edge has the shape of a sharp edge.

According to a special embodiment of this inventive idea, this first edge has a radius not above 1 mm. Even more preferably, the first edge has a radius not above 0.5 mm.

According to the invention, it has also turned out that the way in which gas is released from the channel into the molten metal also depends on the width of the channel mouth, i.e. the width of the channel in the area in which the channel merges into the exterior surface of the nose. Preferably, the channel mouth has a width in the range from 2 to 30 mm in the area where the channel (i.e. the walls of the channel) merges into the exterior surface of the nose.

According to a particular preferred embodiment of this feature, the channel comprises a second channel wall, limiting the channel in a direction towards said second end, wherein said second channel wall and said exterior surface of said nose form a second edge, and wherein the distance between said first edge and said second edge is in the range from 2 to 30 mm.

Preferably, the channel has a constant width in the area of its mouth, i.e. the area into which the channel merges into the exterior surface of the nose. In this respect, according to this embodiment, the first edge and the second edge can preferably run parallel to each other.

According to the invention it turned out that the depth of the channel also has an influence on how gas can be introduced from the channel into the molten metal. The channel preferably has a depth in the range from 4 to 15 mm. According to the invention it has been found that gas from the channel can be introduced particularly uniformly into the molten metal if the channel has a depth in the range from 4 to 15 mm. The uniformity of the gas discharge from the channel into the molten metal can be further increased by the channel having a depth in the range from 6 to 12 mm. The "depth" of the channel is defined as the smallest distance of an imaginary plane, extending between the two edges of the channel at its upper end (i.e. between the two edges of the channel where the walls of the channel merge into the exterior surface of the nose), and the lowest point of the channel, i.e. the bottom of the channel.

Furthermore, it turned out according to the invention that the size of the cross-sectional area of the channel also has an influence on how gas can be introduced from the channel into the molten metal. The channel preferably has a cross-sectional area in the range from 2 to 225 $mm^2$. In accordance with the invention, it was found that gas can be introduced particularly uniformly from the channel into the molten metal if the channel has such a cross-sectional area. The uniformity of the release of gas from the channel into the molten metal can be further enhanced by the channel having a cross-sectional area in the range from 8 to 70 $mm^2$.

The rod-shaped stopper body and the chamber extending along the central longitudinal axis in the stopper body may be designed according to the state of the art. In this respect, the rod-shaped stopper body can preferably be made of a refractory material, especially a ceramic refractory material. In particular, the rod-shaped stopper body may be made of a refractory material based on alumina ($Al_2O_3$) and carbon, i.e. a so-called alumina-carbon material.

The rod-shaped stopper body may preferably have an outer circumferential surface being rotationally symmetrical in relation to the central longitudinal axis. This favours the uniform flow of the gas, released from the channel, along the stopper body and thus the formation of a uniform gas curtain around the stopper rod.

In the area of the first end, which forms the upper end of the stopper body in the functional position of the stopper rod, i.e. with the central longitudinal axis aligned vertically, means may be provided on the stopper body by which the stopper body can be attached to a device for lifting and lowering the stopper rod vertically. These means may be designed according to the state of the art. For example, fasteners with an internal thread into which a metal rod with an external thread can be screwed may be provided. This metal rod in turn can interact with a lifting device in such a way that the stopper rod can be lifted and lowered via the metal rod.

In the area of its second end, being opposite the first end and being the lower end of the stopper body in the functional position of the stopper rod, the exterior surface (i.e. the outer contour) of the stopper body has the shape of a nose or stopper nose, as known from the state of the art. Preferably, the exterior surface of the nose is rotationally symmetrical in relation to the longitudinal axis.

The exterior surface of the nose preferably expands from the second end towards the first end. According to a preferred embodiment, the exterior surface of the nose expands from the second end in the direction towards the first end conically or is formed as a cone. According to a particularly preferred design, the exterior surface of the nose is dome-shaped.

The channel is provided on the exterior surface of the nose.

As known from the state of the art, the stopper rod has a chamber which extends along the central longitudinal axis into said stopper body from the first end towards said second end and ends in the stopper body at a distance from the second end. This chamber may preferably be rotationally symmetrical in relation to the central longitudinal axis and, for example, have a circular-cylindrical shape. The stopper rod according to the invention comprises gas supply means leading from said chamber through said rod-shaped stopper body into said channel. Thus, gas introduced into the chamber, in particular inert gas such as argon or nitrogen, can be passed through the gas supply means into the channel.

To supply gas to the chamber, the chamber can be connected to a gas supply. This gas supply can be provided, as known from the state of the art, especially in the area of the first end of the stopper body.

The gas supply means are designed in such a way that gas can be passed from the chamber through the stopper body into the channel.

According to one embodiment, the gas supply means may be at least one porous element. This at least one porous element has a porosity allowing gas to pass through the at least one porous element from the chamber to the channel. The at least one porous element may, for example, have a porosity known from porous purging plugs for gas purging of molten metal in ladles.

According to a particularly preferred embodiment, the gas supply means are a plurality of gas supply lines. These gas supply lines have a free cross-sectional area through which gas can be conducted from the chamber into the channel.

According to a preferred embodiment, it is provided that the said gas supply means are a plurality of gas supply lines, with each of said gas supply lines leading into said channel at an area, wherein said areas are spaced from each other.

In accordance with the invention, it was found that gas from the chamber via the gas supply lines can be conducted particularly uniformly into the channel and can be released from the channel into the molten metal when the gas supply lines lead into the duct at areas spaced apart from each other. A number of 2 to 10 gas supply lines are preferred, and 3 to 6 gas supply lines are even more preferred. Accordingly, these gas supply lines lead into the channel at 2 to 10 or 3 to 6 areas spaced apart from each other. In accordance with the invention, it was found that gas is particularly uniformly conducted into the channel and uniformly from there into the molten metal if gas is conducted into the channel via such a number of gas supply lines—which lead into the duct with a corresponding number of areas spaced apart from each other.

The areas where the gas supply lines lead into the duct are preferably located at the bottom or lowest point of the channel. In accordance with the invention, it has been found that this design allows the gas fed into the channel to remain in the channel for such a long time that it is distributed evenly in the channel and can then be introduced uniformly from the channel into the molten metal.

According to a preferred embodiment, the areas where the gas supply lines lead into the channel are evenly spaced. Particularly preferred, the areas are symmetrically spaced from each other. Even more preferred, the areas are provided symmetrically in relation to the longitudinal axis. This has the advantage that gas can be conducted into the channel in a particularly uniform manner via the gas supply lines and can be introduced uniformly from the channel into the molten metal.

According to one embodiment, the gas supply means are provided as a combination of gas supply lines and at least one porous element.

According to the invention, the ratio of the cross-sectional area of the gas supply lines to the cross-sectional area of the chamber has an influence on the uniformity with which gas is conducted from the chamber via the gas supply lines into the channel.

According to a preferred embodiment it is provided that the chamber has a cross-sectional area, and wherein each of the gas supply lines has a cross-sectional area, and wherein said cross-sectional area of said chamber is larger than the total area of all of said cross-sectional areas of said gas supply lines. The cross-sectional area of the chamber is measured orthogonally to the central longitudinal axis and the cross-sectional area of each of the gas supply lines is measured orthogonally to the longitudinal axis of the respective gas supply line. As far as the chamber has a changing cross-sectional area, the cross-sectional area of the chamber is the effective cross-sectional area, that is to say the smallest cross-sectional area, allowing gas to be guided through the chamber to the gas supply lines. As far as the gas supply lines have a changing cross-sectional area, the cross-sectional area of the gas supply lines is the effective cross-sectional area, that is to say the smallest cross-sectional area, allowing gas to be guided through the gas supply lines to the channel.

According to a preferred special embodiment of this inventive idea, the cross-sectional area of the chamber is larger than the total area of all of the cross-sectional areas of said areas of said gas supply lines by a factor in the range from 10 to 400, and even more preferred by a factor in the range from 30 to 200.

The gas supply lines can have any shape. The gas supply lines are preferably straight, i.e. linear. According to a special embodiment of this inventive idea, the gas supply lines have a straight course with a circular cross-sectional area. This has the particular advantage that the gas supply lines are easy to produce, for example by drilling them into the stopper body.

According to a preferred embodiment, the gas supply lines are arranged symmetrically in relation to the central longitudinal axis. As shown above, the nose of the stopper body is designed in such a way that it may close the outlet in a vessel for molten metal, in particular an outlet in the form of a tundish nozzle in a tundish. In the closed position, i.e. when the nose of the stopper rod is guided against a tundish nozzle in such a way that the tundish nozzle is closed by the nose of the stopper body, the surface of the tundish nozzle contacts the outer surface of the nose of the stopper body along a continuous line which runs around the nose on the exterior surface of the nose. This imaginary line is also known as the "throttle point". Preferably, for the stopper rod according to the invention it is provided that the channel is provided at such an area of the exterior surface of the nose that runs completely below this throttle point. In other words, the area on the exterior surface of the nose where the channel is provided is located below the throttle point in the functional position of the stopper rod, i.e. in a vertical position of the central longitudinal axis where the first end of the stopper body is located at the top and the second end (and thus also the nose) of the stopper body at the bottom. Since the nose below the throttle point in the closed position is not surrounded by the molten metal, the channel in the closed position is not surrounded by molten metal either.

The inventive stopper rod can be manufactured using state-of-the-art technologies for the production of stopper rods. In this respect, the stopper rod can be produced in the form of a monoblock stopper. The stopper body is preferably produced by isostatic pressing, as is known from the state of the art. In addition to isostatic pressing, the gas supply lines can be produced by drilling, for example. The channel can, for example, be milled out of the surface of the nose.

One object of the invention is the provision of a vessel for holding molten metal, comprising a bottom, wherein an outlet for discharging molten metal from said vessel is provided at said bottom, and wherein the amount of molten metal flowing through said outlet is controlled by the stopper rod according to the invention. The vessel for holding molten metal is preferably a tundish, preferably a tundish for receiving molten metal, even more preferably a tundish for receiving molten steel, in particular in a continuous casting plant. The outlet is preferably a tundish nozzle.

A further object of the invention is a method of providing a uniform gas curtain around a stopper rod, the method comprising:

providing a stopper rod as disclosed herein;

introducing a gas into said chamber.

The gas introduced into the chamber is conducted through the gas supply means to the channel. Due to the inventive features, the channel is designed in such a way that the gas, conducted into the channel via the gas supply means, is released uniformly from the channel, forming a uniform gas curtain around the stopper rod.

Accordingly, the method may comprise the following further steps, being after the step of introducing a gas into said chamber:

Conducting said gas, being introduced into said chamber, to said channel by said gas supply means;

releasing said gas from said channel to form a uniform gas curtain around the stopper rod.

During the casting of molten metal, deflection of the stopper rod can be significantly reduced, thereby improving the quality of the cast steel.

As mentioned above, the gas can be introduced into the chamber, for example at the first end, preferably by the state of the art means.

An inert gas, in particular argon or nitrogen, is preferably introduced into the chamber.

As mentioned above, the stopper rod is provided with its longitudinal axis being aligned vertically, with the first end being the upper end of the stopper body and the second end being the lower end of the stopper body.

A further object of the invention is a method for controlling the flow of molten metal and for supplying gas during casting of molten metal, said method comprising:

Providing a vessel for holding molten metal, said vessel comprising a bottom, wherein an outlet for discharging molten metal from said vessel is provided at said bottom;

providing a stopper rod as disclosed herein, wherein the longitudinal axis is aligned vertically, with the first end being the upper end of the stopper body and the second end being the lower end of the stopper body;

moving said stopper rod vertically along said longitudinal axis in a first position and in a second position, wherein in said first position, said outlet is closed by said stopper rod, and wherein in said second position, said outlet is not closed by said stopper rod; and introducing a gas into said chamber.

The method may comprise the following further steps, being after the step of introducing a gas into said chamber at said first end:

Conducting said gas, being introduced into said chamber, to said channel by said gas supply means;

releasing gas from the channel into said molten metal to form a uniform gas curtain around the stopper rod.

This method may comprise the further steps of the method for providing a uniform gas curtain around a stopper rod, as set forth above.

As set forth above, said vessel preferably is a tundish, wherein said outlet preferably is a tundish nozzle. Said tundish preferably is part of a continuous casting line, preferably for casting steel.

The stopper rod is preferably provided above the outlet, preferably with the longitudinal axis running through the outlet.

By moving said stopper rod in said first and second position and, hence, closing and opening said outlet, controlling the flow of molten metal from said vessel through said outlet is possible. As set forth above, in the first position, the nose of the stopper rod is guided against the outlet in such a way that the outlet is closed.

As set forth above, moving of the stopper rod vertically is preferably done by means of a lifting device. Accordingly, moving the stopper rod in said first position is done by lowering the stopper rod by means of said lifting device along said longitudinal axis and moving the stopper rod in said second position is done by lifting the stopper rod by means of said lifting device along said longitudinal axis.

Further, as set forth above, by introducing a gas into said chamber, preferably at the first end of the stopper body, this gas is conducted from the chamber and through the gas supply means to the channel, collected and evenly distributed in the channel and finally introduced from said channel into the metal melt, thereby forming a uniform gas curtain around a stopper rod. Due to the uniformity of said gas curtain, deflections of the stopper rod during casting can be reduced.

Further characteristics of the invention result from the claims, the figures as well as the following figure description.

All features of the invention can be combined individually or in combination.

Figure 1B:
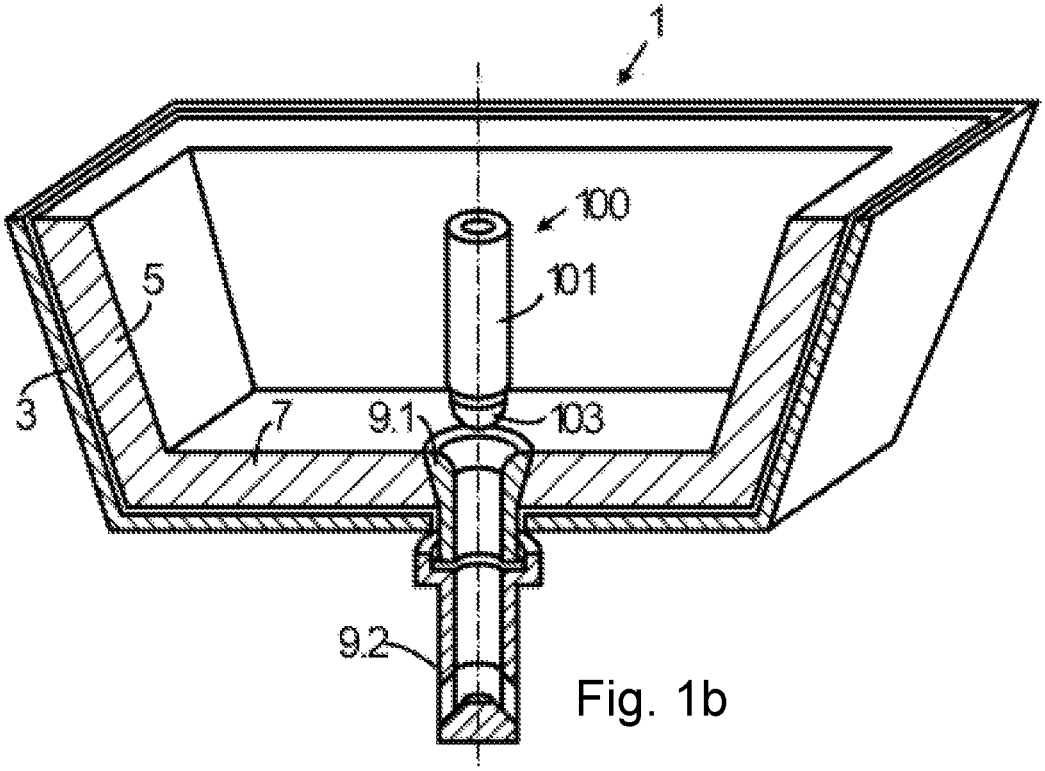
Figure 2:
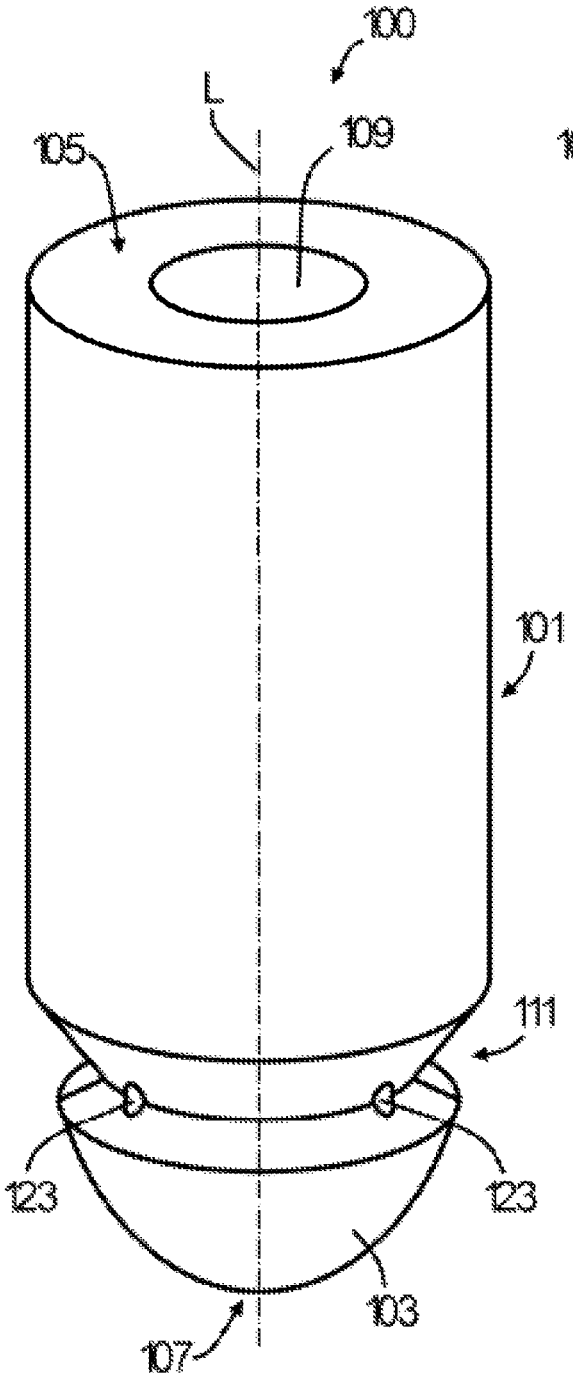

The figures, each strongly schematized, show exemplary embodiments of the invention. Thereby shows FIG. 1*a* a cross-sectional view of a tundish comprising a stopper rod according to the invention, wherein in the bottom of the tundish there is provided an outlet in the form of a submerged entry nozzle;

FIG. 1*b* a cross-sectional view of an alternative embodiment of a tundish comprising a stopper rod according to the invention, wherein in the bottom of the tundish there is provided an outlet in the form of a submerged entry shroud;

FIG. 2 a perspective view of the stopper rod according to FIGS. 1*a* and 1*b;*

Figure 3:
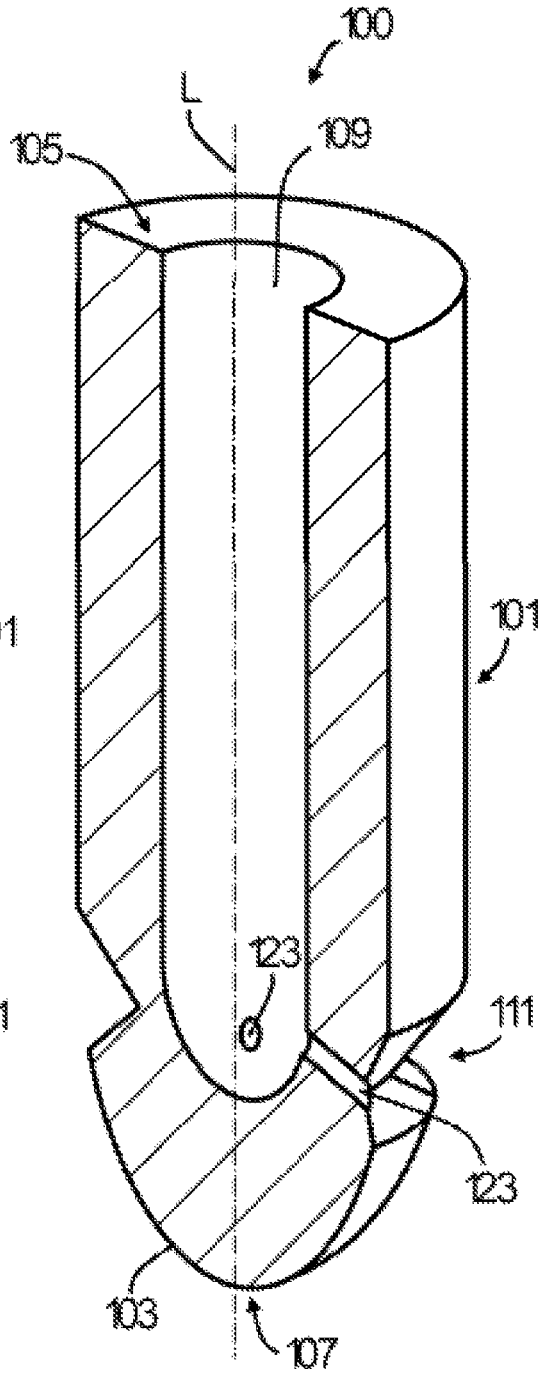

FIG. 3 a perspective view of a longitudinal section along the longitudinal axis of the stopper rod as shown in FIGS. 1*a* and 1*b;*

Figure 4:
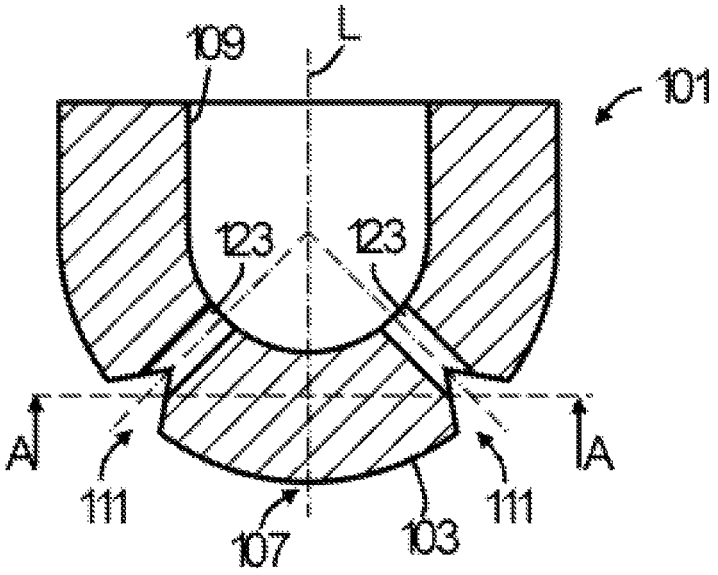
Figure 5:
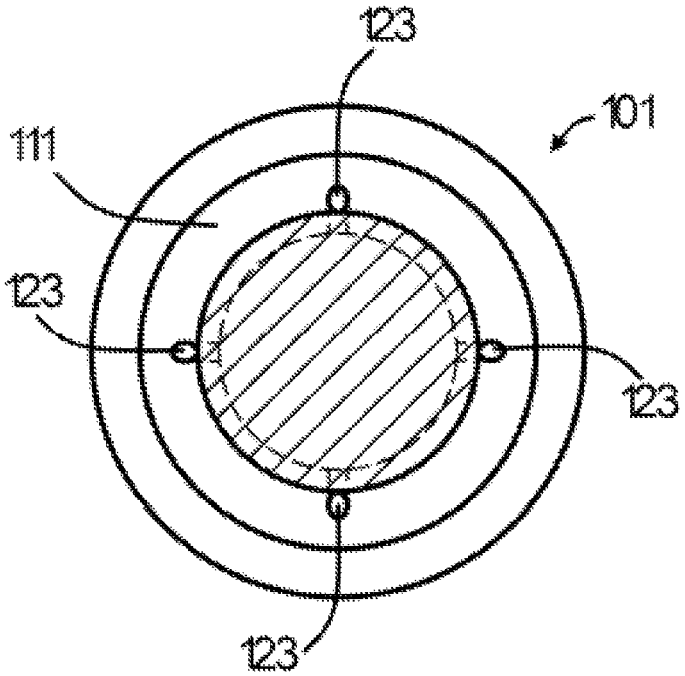
Figure 6:
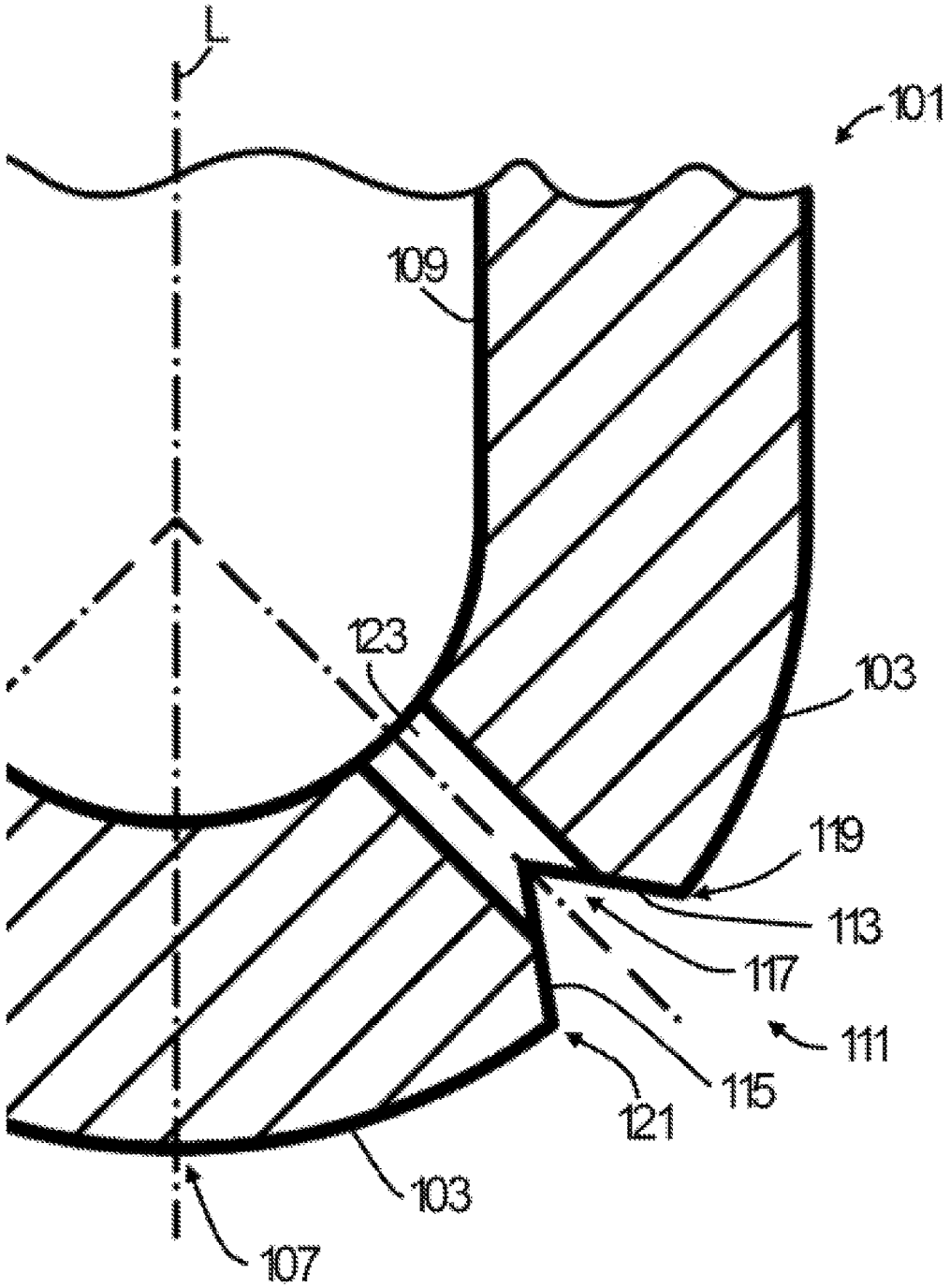
Figure 7:
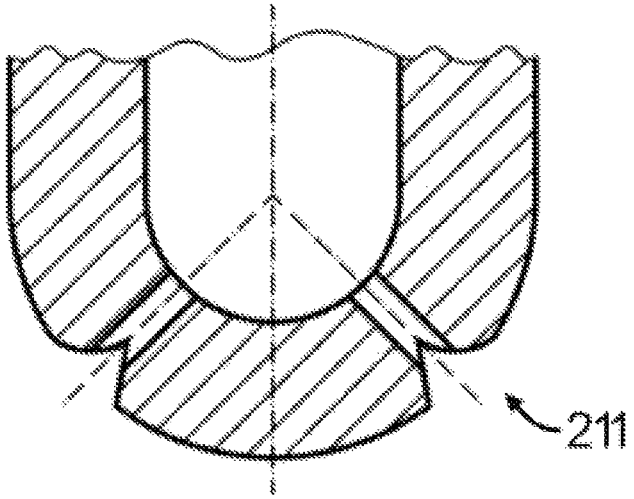
Figure 8:
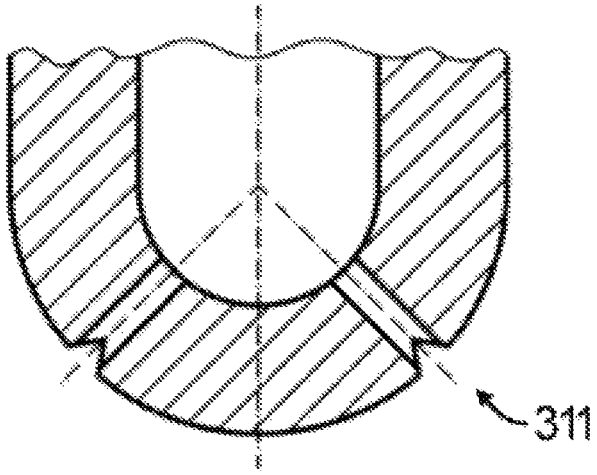
Figure 9:
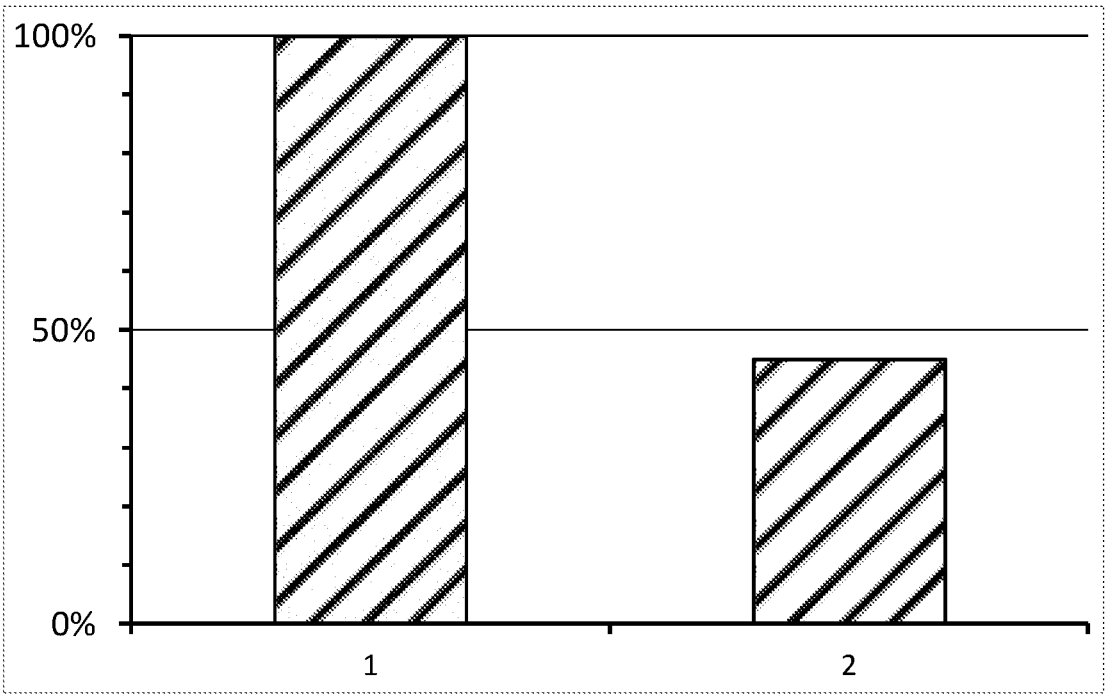

FIG. 4 a view of a longitudinal section along the longitudinal axis of the stopper rod as shown in FIGS. 1*a* and 1*b* in the nose area;

FIG. 5 a view of a cross-section perpendicular to the longitudinal axis of the stopper rod as shown in FIGS. 1*a* and 1*b* along the section plane A-A as shown in FIG. 4;

FIG. 6 a detail of the view according to FIG. 4 in the area of the channel;

FIG. 7 a view according to FIG. 4, but with an alternative design of the channel;

FIG. 8 a view according to FIG. 4, but with a further alternative design of the channel;

FIG. 9 shows the deflection of the stopper rod according to the design shown in FIGS. 1 to 6 and of a stopper rod according to the art when gas passes through the stopper rods.

In order to better illustrate the features of the embodiments shown in the figures, the figures do not reflect the proportions of the embodiments according to practice.

FIG. 1*a* shows a tundish identified in its entirety by the reference sign 1, which is part of a continuous casting plant for casting steel. Tundish 1 comprises, as is known from the state of the art, a metal vessel 3 lined on its inside with a refractory material 5. Molten metal can be provided in the space enclosed by the refractory material 5. In the bottom 7 of tundish 1, a tundish nozzle 9 in the form of a submerged entry nozzle (SEN) is provided through which molten metal in tundish 1 can be cast into a mould (not shown). A vertically aligned longitudinal axis L runs through the tundish nozzle 9.

Along the longitudinal axis L a stopper rod 100 is arranged in its functional position. The stopper rod 100 is connected to a state of the art lifting device (not shown) by means of which the stopper rod 100 can be lifted and lowered along the longitudinal axis L. The stopper rod 100 comprises a stopper body 101 which defines a stopper nose 103 at its lower end. By means of the lifting device, the stopper rod 100 can be lifted into the second position shown in FIG. 1*a*, in which the tundish nozzle 9 is open, so that a molten metal provided in the tundish 1 can be casted through the tundish nozzle 9 into the submerged entry nozzle. Furthermore, the stopper rod 100 can be lowered by means of the lifting device into a first position (not shown in FIG. 1*a*) in which the stopper nose 103 rests against the tundish nozzle 9 in such a way that it is closed by the stopper rod 100. Accordingly, the tundish nozzle 9 can be closed and opened by means of the stopper rod 100, thereby controlling the amount of molten metal flowing through the tundish nozzle 9.

The tundish 1 shown in FIG. 1*b* is broadly identical to the tundish shown in FIG. 1*a* and indicated with the same reference signs as far as the tundish 1 according to FIG. 1*a* is identical to the tundish 1 according to FIG. 1*b*. The only difference between the tundish 1 according to FIGS. 1*a* and 1*b* lies in the fact that in the bottom 7 of tundish 1 according to FIG. 1*b* there is provided a tundish nozzle 10 in the form of a submerged entry shroud (SES). As known from the art, submerged entry shroud 10 is comprised of an upper part 10.1, located at the bottom 7 of tundish 1, and a lower part 10.2, attached below upper part 10.1 such that the upper part 10.1 and the lower part 10.2 form a continuous chamber along the central longitudinal axis of submerged entry shroud 10.

FIG. 2 shows the stopper rod 100 as shown in FIG. 1 in a perspective view from above. The stopper rod 100 comprises a rod-shaped stopper body 101, the outer circumferential surface of which is rotationally symmetrical to the central longitudinal axis L of the stopper rod 100. In the example shown in FIG. 1, the longitudinal axis L and the central longitudinal axis L of the stopper rod 100 run coaxially to each other or are identical, respectively. The stopper body 101 extends along the central longitudinal axis L from its first, upper end 105 in the functional position according to FIG. 1 to its second, lower end 107 in the functional position according to FIG. 1. Starting from the second end 107, the stopper body 101 defines the nose 103 which, starting from the second end 107, has a dome-shaped shape. The external surface of the nose 103 is rotationally symmetrical to the longitudinal axis L.

The outer surface of the stopper body 101, which extends from the first end 105, has a circular cylindrical outer contour rotationally symmetrical to the central longitudinal axis L.

The stopper body 101 has a chamber 109 which, as shown in FIG. 3, extends along the central longitudinal axis L from the first end 105 in a direction towards the second end 107 into the stopper body 101 and ends in the stopper body 101 at a distance from the second end 107.

The stopper body 101 is made of a refractory material in the form of an alumina carbon material ($Al_2O_3$—C material).

A gas supply (not shown) is provided in the area of the first end 105, through which an inert gas such as argon or nitrogen can be fed into chamber 109.

A channel 111 is arranged on the outer surface of nose 103. The channel 111 runs continuously around the longitudinal axis L and is rotationally symmetrical to it, so that the channel 111 as a whole has the shape of a circular ring. As FIGS. 4 and 6 in particular show, channel 111 has a V-shaped cross-sectional area which is uniform, i.e. does not change along the course of channel 111. The channel 111 is completely open to the outside, i.e. on the side of the channel 111 facing away from the stopper body 101, and is, according to its V-shaped cross-sectional area, limited by a first wall 113 and a second wall 115, which start from a common linear area 117, which forms the channel bottom of the channel 111. Towards the outer surface of nose 103, the first and second walls 113, 115 diverge and finally merge into the outer surface of nose 103. The first channel wall 113 is limiting the channel 111 in a direction towards the first end 105 and forms a first edge 119 with the outer surface of the nose 103. The second channel wall 115 is limiting the channel 111 in a direction towards the second end 107 and forms a second edge 121 with the outer surface of the nose 103. The first edge 119 and the second edge 121 each form a sharp edge with a radius well below 0.5 mm.

The first and second edges 119 and 121 run equally spaced to each other and rotationally symmetrically around the longitudinal axis L, corresponding to the even course of channel 111. The distance between the first and second edges 119, 121 defines the width of the channel mouth, i.e. the width of channel 111 in the area in which channel 111 merges into the outer surface of nose 103 and is 10 mm in the embodiment. The shortest distance between an imaginary plane that extends between the first and second edges 119, 121 and the channel bottom 117 defines the depth of channel 111, which in the embodiment is 8 mm. This results in a cross-sectional area of channel 111 of 40 $mm^2$.

From chamber 109, gas supply means in the form of four gas supply lines 123 lead through the refractory material of the stopper body 101 into channel 111. The four gas supply lines 123 each have a straight course with a circular cross-sectional area and are arranged symmetrically with respect to the longitudinal axis L and are evenly spaced from each other. Accordingly, the four gas supply lines 123 are spaced from each other by a rotation angle of 90° with respect to the longitudinal axis L. In accordance with their symmetry with respect to the longitudinal axis L, the gas supply lines 123 lead into channel 111 at four evenly spaced areas, which are also spaced at a rotation angle of 90° with respect to the longitudinal axis L, as can be seen particularly clearly in FIG. 5.

The gas supply lines 123 each extend along a longitudinal axis, with the four longitudinal axes of the gas supply lines 123 intersecting at a common point on the longitudinal axis L. The four longitudinal axes of the gas supply lines 123 are each arranged at an angle of approximately 45° to the central longitudinal axis L of the stopper body 101, this angle being included between the section of the longitudinal axes of the gas supply line 123 passing through the gas supply lines 123 and the section of the central longitudinal axis L of the stopper body 101 passing through the second end 107 of the stopper body 101.

Chamber 109 has a cross-sectional area of 1,300 $mm^2$ and each of the gas supply lines has a cross-sectional area of 3 $mm^2$. Thus, the cross-sectional area of chamber 109 is larger by the factor 108 than the total area of the cross-sectional areas of the gas supply lines 123.

In the area of the first end 105, the stopper body 101 has state of the art fasteners for fastening the stopper body 109 to a lifting device for lifting and lowering the stopper rod 100.

To produce the stopper rod 100, the stopper body 101 was first formed by isostatic pressing of the refractory material, whereby the fastener for fastening the stopper body 101 to the lifting device was formed into the refractory material (not shown in the Figures). The four gas supply lines 123 were then drilled into the isostatically pressed refractory material.

The stopper rod 100 is designed to form a uniform gas curtain around the stopper rod 100. For this purpose, during the use of the stopper rod 100 in tundish 1 as shown in FIG. 1, an inert gas is introduced into chamber 109 via the gas supply and passed through the four gas supply lines 123 through the stopper body 101 into channel 111. In channel 111, the gas can collect, distribute and then be discharged from channel 111, forming a uniform gas curtain around the stopper rod 100. During casting of molten metal from the tundish 1, this can significantly reduce the deflection of the stopper rod 100, thus improving the quality of the cast metal.

In order to determine the deflection reduction depending on the design of the channel of a stopper rod according to the invention, the deflection of the stopper rod 100 according to FIGS. 1 to 6 and the deflection of two alternative stopper rods, being in accordance with the stopper rod according to FIGS. 1 to 6, but each with a slightly different cross-sectional shape of the channel, were measured by means of water modelling. The two alternative cross-sectional shapes of the channel are shown in FIGS. 7 and 8.

The cross-sectional shape of channel 211 as shown in FIG. 7 corresponds to the cross-sectional shape of channel 111 except that the first side wall of the channel facing the first end 107 does not merge into the surface of nose 103 in the form of a sharp edge but in the form of a round edge, having a radius of about 5 mm.

Channel 311 according to FIG. 8 essentially corresponds to the shape of channel 111, but with a smaller channel depth of only 3 mm.

To determine the degree of deflection, the deflection of stopper rods was determined by optical assessment of a recorded image sequence. The horizontal movement of the stopper rod changed the pixel colour, from which the number of pixels with changed colour as a function of time was determined. A deflection index was calculated as the standard deviation value of changed pixels normalized to 100% for the value obtained for a stopper rod according to the art. Based upon this deflection index, the degree of deflection for a stopper rod according to FIGS. 1-6 has been measured and calculated.

The stopper rod according to the art was broadly identical to the stopper rod according to FIGS. 1-6 but with the differences, that the stopper rod according to the art did not comprise the channel 111 and the gas supply lines 123 but instead comprised a gas outlet along the central longitudinal axis in the nose area as described in EP 2 067 549 A1, EP 2 189 231 A1 or EP 2 233 227 A1.

FIG. 9 shows the results of the corresponding measurements. In FIG. 9, reference number 1 indicates the results of the measurement for the stopper rod according to the art with the deflection index being calculated as the standard deviation value of changed pixels normalized to 100%. Further, reference number 2 indicates the results of the measurement for the stopper rod according to FIGS. 1-6.

As can be seen from FIG. 9, the deflection of the stopper rod according to FIGS. 1-6 is only about 45% of the deflection index, and accordingly the deflection of the stopper rod according to FIGS. 1-6 is significantly below the deflection of a stopper rod according to the art.

The invention claimed is:

1. Stopper rod (100) for controlling the flow of molten metal and for supplying gas during casting of molten metal, said stopper rod (100) comprising:

1.1 a rod-shaped stopper body (101), said rod-shaped stopper body (101)

1.1.1 extending along a central longitudinal axis (L) from a first end (105) to a second end (107), 1.1.2 said rod-shaped stopper body (101) defining a nose (103) adjacent to said second end (107), wherein 1.1.3 said nose (103) provides an exterior surface;

1.2 a chamber (109), said chamber (109)

1.2.1 extending along said central longitudinal axis (L) into said stopper body (101) from said first end (105) towards said second end (107) and ending at a distance from said second end (107);

1.3 a channel (111), said channel (111)

1.3.1 being provided on said exterior surface of said nose (103), 1.3.2 running around said longitudinal axis (L); and 1.3.3 having a depth in the range of 4 to 15 mm;

1.4 gas supply means (123), said gas supply means (123)

1.4.1 leading from said chamber (109) and through said rod-shaped stopper body (101) into said channel (111).

2. The stopper rod (100) according to claim 1, with said channel (111) forming a ring.

3. The stopper rod (100) according to claim 1, with said exterior surface of said nose (103) being rotationally symmetrical in relation to said longitudinal axis (L).

4. The stopper rod (100) according to claim 1, wherein said channel (111) comprises a first channel wall (113), limiting the channel (111) in a direction towards said first end (105), wherein said first channel wall (113) and said exterior surface of said nose (103) form a first edge (119), and wherein said first edge (119) has the shape of a sharp edge.

5. The stopper rod (100) according to claim 4, wherein said first edge (119) has a radius not above 1 mm.

6. The stopper rod (100) according to claim 4, wherein said channel (111) comprises a second channel wall (115), limiting the channel (111) in a direction towards said second end (107), wherein said second channel wall (115) and said exterior surface of said nose (103) form a second edge (121), and wherein the distance between said first edge (119) and said second edge (121) is in the range from 2 to 30 mm.

7. The stopper rod (100) according to claim 1, wherein said channel (111) has a depth in the range from 6 to 12 mm.

8. The stopper rod (100) according to claim 1, wherein said channel (111) has a cross section area in the range from 2 to 225 $mm^2$.

9. The stopper rod (100) according to claim 1, wherein said gas supply means (123) are a plurality of gas supply lines (123), with each of said gas supply lines (123) leading into said channel (111) at an area, wherein said areas are spaced from each other.

10. The stopper rod (100) according to claim 9, wherein said areas are symmetrically spaced from each other.

11. The stopper rod (100) according to claim 9 having a total number of gas supply lines (123) in the range from 2 to 10.

12. The stopper rod (100) according to claim 9, wherein said chamber (109) has a cross-sectional area, and wherein each of the gas supply lines (123) has a cross-sectional area, and wherein said cross-sectional area of said chamber (109) is larger than the total area of all of said cross-sectional areas of said gas supply lines (123).

13. The stopper rod (100) according to claim 1, wherein said stopper body (101) is made of a refractory ceramic material.

14. A method for providing a uniform gas curtain around a stopper rod, said method comprising:

A. providing the stopper rod (100) according to claim 1; and

B. introducing a gas into said chamber (109).

* * * * *